US007726640B2

(12) United States Patent
Nochi et al.

(10) Patent No.: US 7,726,640 B2
(45) Date of Patent: Jun. 1, 2010

(54) SHEET CUTTING APPARATUS

(75) Inventors: Toshiaki Nochi, Joso (JP); Hiroki Hommochi, Moriya (JP)

(73) Assignee: Canon Finetech, Inc., Misato-shi (JP)

( * ) Notice: Subject to any disclaimer, the term of this patent is extended or adjusted under 35 U.S.C. 154(b) by 0 days.

(21) Appl. No.: 12/134,744

(22) Filed: Jun. 6, 2008

(65) Prior Publication Data

US 2008/0308990 A1 Dec. 18, 2008

(30) Foreign Application Priority Data

Jun. 12, 2007 (JP) ..... 2007-155167

(51) Int. Cl.

| | |
|---|---|
| ***B65G 33/04*** | (2006.01) |
| ***B41F 13/58*** | (2006.01) |
| ***B41F 13/56*** | (2006.01) |
| ***B26D 7/02*** | (2006.01) |
| ***B23Q 15/00*** | (2006.01) |

(52) U.S. Cl. ..... 270/58.07; 270/5.02; 270/21.1; 83/452; 83/72

(58) Field of Classification Search ..... 270/58.07, 270/5.02, 21.1, 52.17

See application file for complete search history.

(56) References Cited

U.S. PATENT DOCUMENTS

2007/0085256 A1 * 4/2007 Miyake et al. ..... 270/52.18

FOREIGN PATENT DOCUMENTS

JP 2006-263855 A 10/2006
JP 2006263855 A * 10/2006

* cited by examiner

*Primary Examiner*—Gene Crawford
*Assistant Examiner*—Yolanda Cumbess
(74) *Attorney, Agent, or Firm*—Fitzpatrick, Cella, Harper & Scinto

(57) ABSTRACT

A sheet cutting apparatus, including: a cutting knife for cutting a sheet bundle including a plurality of sheets; a sub-waste box capable of temporally receiving cutting wastage of a sheet bundle which has been cut; and a main waste box capable of receiving the cutting wastage received in the sub-waste box, in which the main waste box is constructed so that a wastage disposal operation of the cutting wastage received in the main waste box can be made while the sub-waste box temporally receives the cutting wastage.

4 Claims, 9 Drawing Sheets

SHEET CUTTING APPARATUS

BACKGROUND OF THE INVENTION

1. Field of the Invention

The present invention relates to a sheet cutting apparatus for trimming a sheet bundle, for example, a top edge, a tail edge, and a fore edge of a covered book.

2. Description of the Related Art

Hitherto, as described in Japanese Patent Application Laid-open No. 2006-263855, for example, in a bookbinding process, a cover sheet is attached to a sheet bundle with glue, and portions other than the portion to which the cover is glued, such as a top edge, a tail edge, and a fore edge, are cut (trim). For those cutting processes, a sheet cutting apparatus as disclosed in Japanese Patent Application Laid-open No. 2006-263855 is used, and is configured so that the cutting wastage generated at the time of cutting the top edge, the tail edge, and the fore edge falls down as it is, and the cutting wastage is introduced into a waste box using a switching device such as a flapper. Further, the sheet bundle which has been subjected to cutting is guided and conveyed to an accumulation portion which may be pulled out by switching the flapper.

Then, the waste box has such a construction that a user can access thereto (construction capable of pulling it out from an apparatus main body), and therefore, the user pulls out the waste box while the device is not operated to dispose the cutting wastage accumulated in the waste box.

However, in the sheet cutting apparatus having a construction described above, when the cutting wastage is to be disposed, the device must be stopped for pulling out the waste box, resulting in a cutting operation stop. Further, during the sheet bundle cutting state, the cutting wastage is in a state of always being flow out, the user must pick the fallen down wastage up later as well as, there causes a problem of safety in operation because the user can access the cutting knife.

In addition, there is employed a construction in which the cutting wastage is guided so as to shift from a conveying path to an accumulation portion for containing bookbinding bundles to the waste box by using a switching flapper, a larger space is needed, and further, a switching mechanism for switching the path by using the switching flapper becomes complicate, resulting in a big obstacle for realizing space-saving and cost reduction.

SUMMARY OF THE INVENTION

The present invention has been made in view of the above-mentioned problems, and therefore has an object to provide a sheet cutting device with a simple structure and easy operability for a user to dispose cutting wastage with safety.

In order to solve the above-mentioned problems, a sheet cutting apparatus according to the present invention includes: a cutting knife for cutting a sheet bundle including a plurality of sheets; a sub-waste box capable of temporally receiving cutting wastage of a sheet bundle which has been cut; and a main waste box capable of receiving the cutting wastage received in the sub-waste box, in which the main waste box is constructed so that wastage disposal operation of the cutting wastage received in the main waste box can be made while the sub-waste box is temporally receiving the cutting wastage.

According to the sheet cutting apparatus having the above-mentioned construction, during the cutting operation, the cutting wastage can be received by the sub-waste box, and in this state the wastage disposal operation of the cutting wastage in the main waste box can be made, and therefore, cutting operation is not stopped, and it is possible to prevent the cutting wastage from becoming a state of always being flow out.

Further, in the sheet cutting apparatus having the above-mentioned construction, the sub-waste box is provided above the main waste box and is movable so that the cutting wastage is allowed to fall down in the main waste box.

In this construction, the sub-waste box is arranged so as to directly receive the cutting wastage in a conveying path of the sheet bundle, so the cutting wastage can be efficiently received, as well as the entire apparatus can be designed so as to achieve space saving and the construction thereof can be simplified.

Further, in the sheet cutting apparatus having the above-mentioned construction, the main waste box may be constructed so that the main waste box can be pulled out from a sheet cutting apparatus main body while the sub-waste box is temporally receiving the cutting wastage.

As described above, when the main waste box is pulled out and removed from the apparatus main body, the sub-waste box can receive the cutting wastage above the main waste box as it is.

Further, in the sheet cutting apparatus having the above-mentioned construction, in wastage disposal operation of the main waste box, the sub-waste box may be constructed so that an access to the cutting knife is prevented from occurring.

To be specific, for example, even if the main waste box is removed, the sub-waste box is positioned so as to block the cutting knife, a user is prevented from accessing to the cutting knife, and is secured in safety during operation.

Further features of the present invention will become apparent from the following description of exemplary embodiments with reference to the attached drawings.

DESCRIPTION OF THE EMBODIMENTS

Now description is made of embodiments of the present invention with reference to the drawings.

Figure 1:
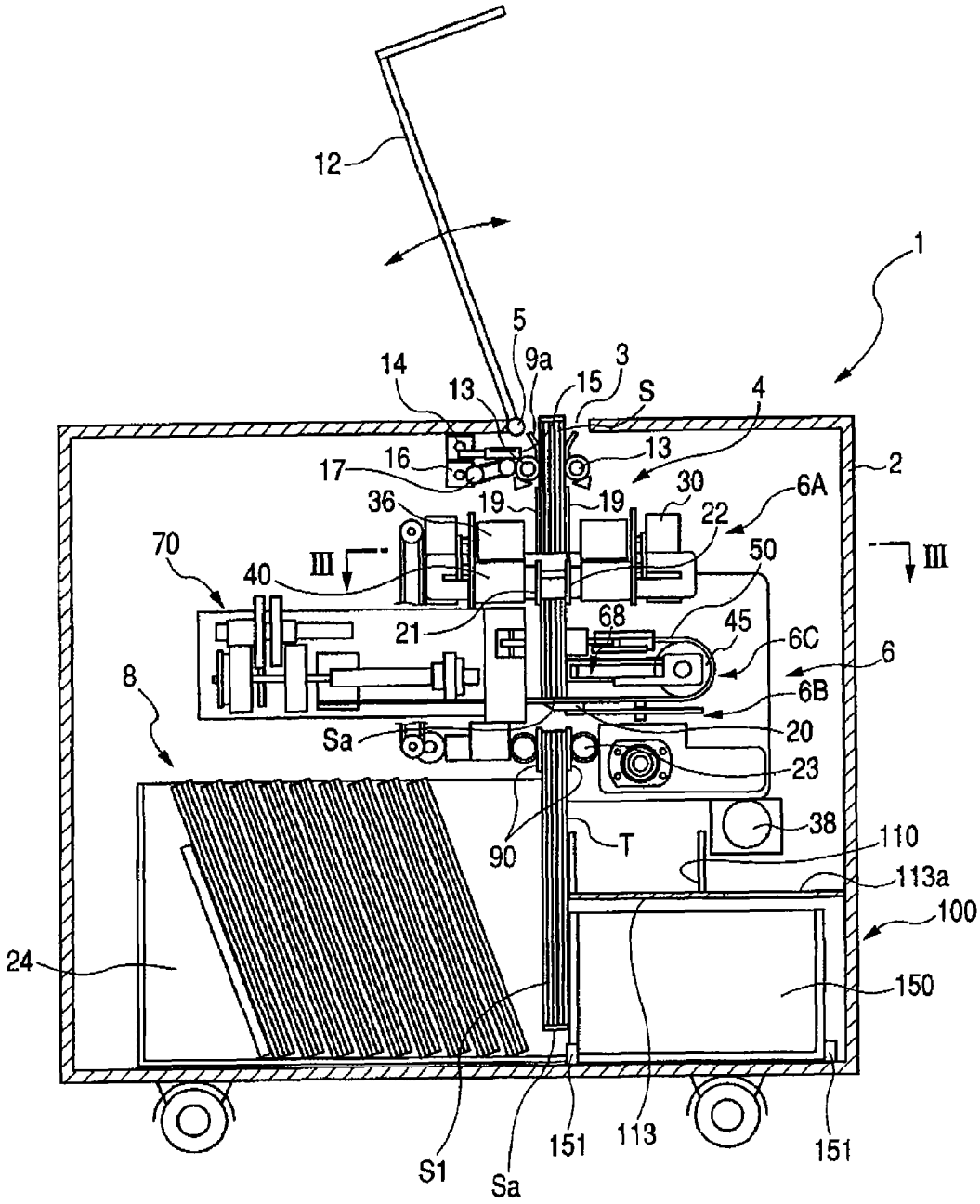
FIG. 1 illustrates a sheet cutting apparatus of a first embodiment according to the present invention, and illustrates a schematic overall construction thereof.
Figure 2:
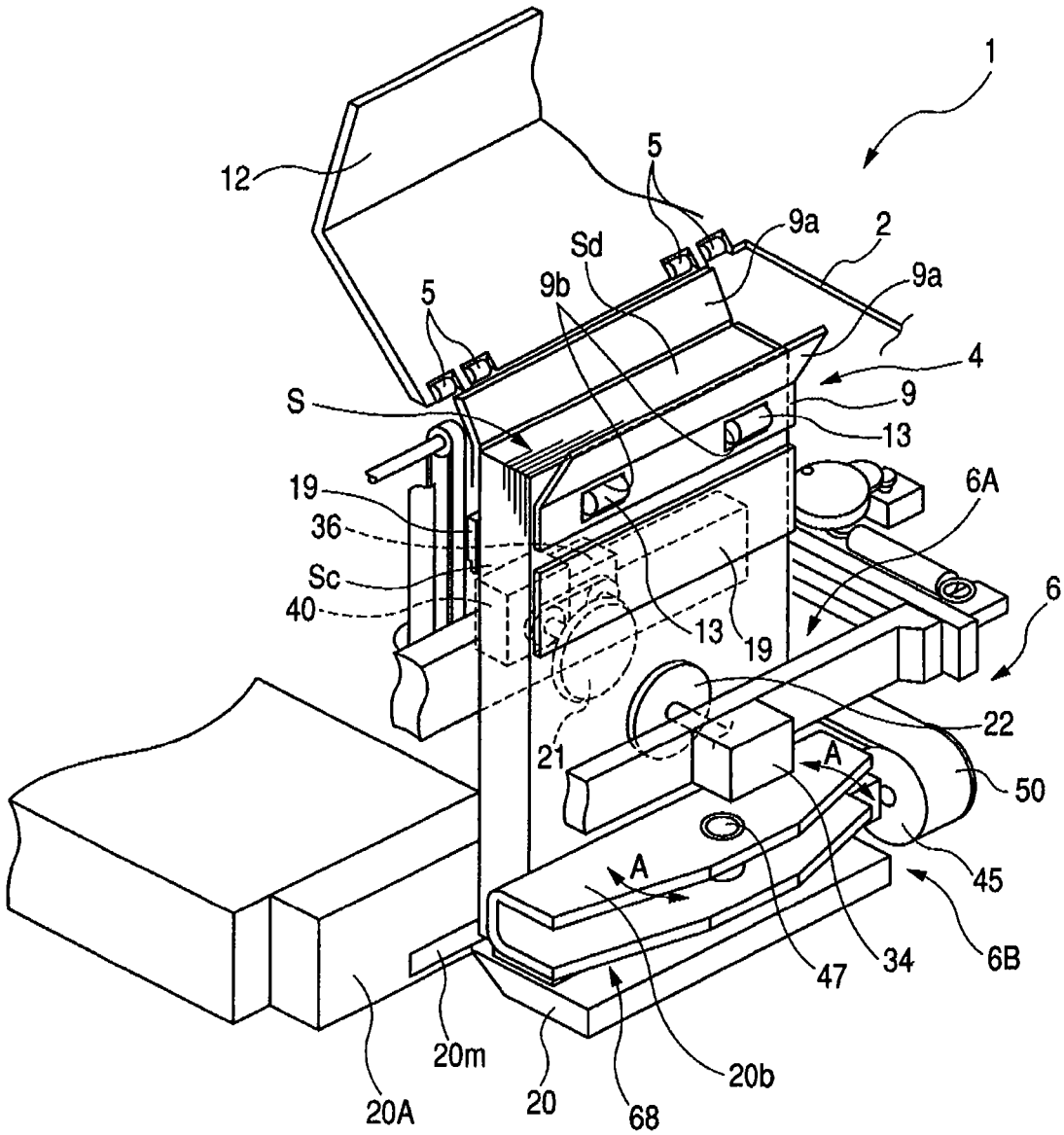
FIG. 2 is a perspective view illustrating a schematic construction of a sheet bundle positioning unit and a cutting section.
Figure 3:
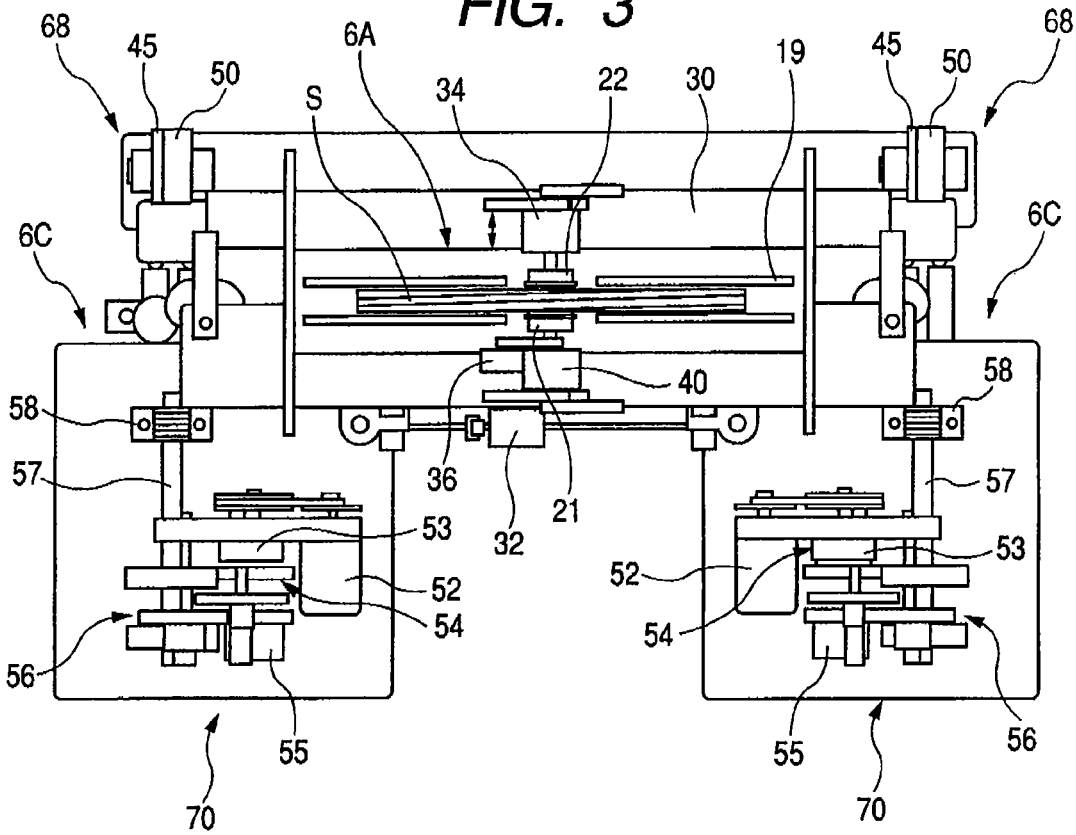
FIG. 3 is a diagram viewed along a direction shown by an arrow III of FIG. 1.
Figure 4:
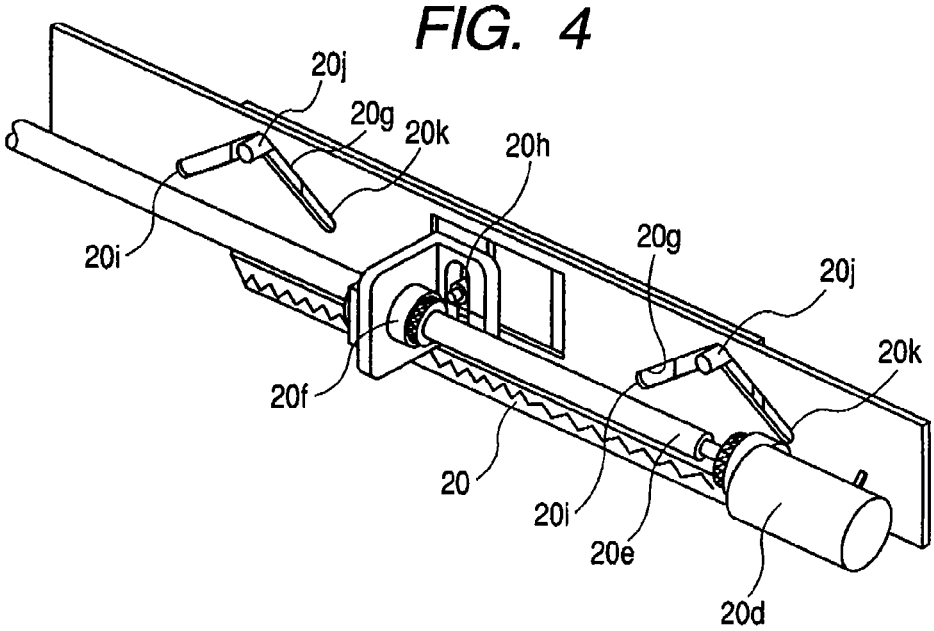
FIG. 4 is a diagram illustrating the construction of a cutting knife driving portion.
Figure 5A:
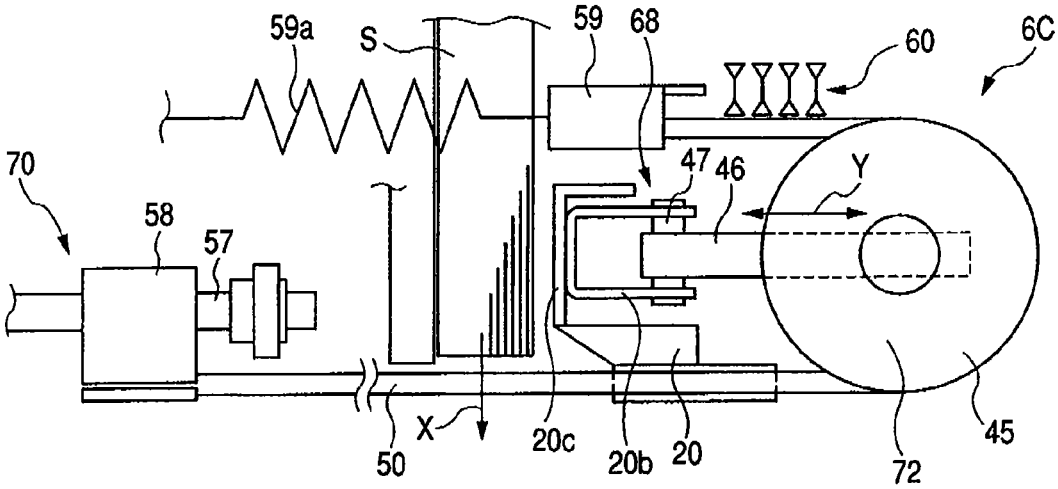
FIG. 5A is a diagram illustrating a press releasing state of a sheet bundle pressing unit of the sheet cutting apparatus of FIG. 1.
Figure 5B:
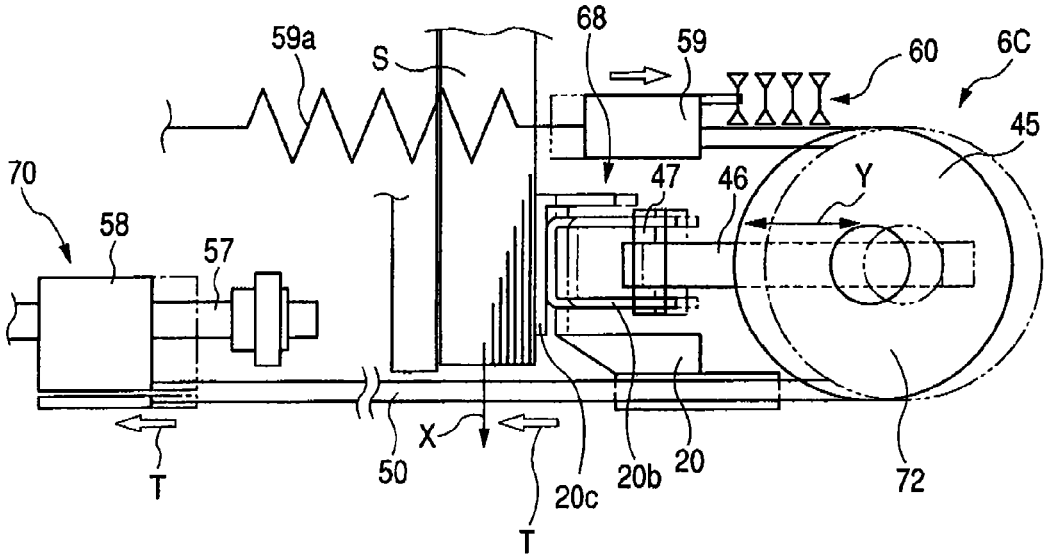
FIG. 5B is a diagram illustrating a pressing state of the sheet bundle pressing unit.
Figure 6A:
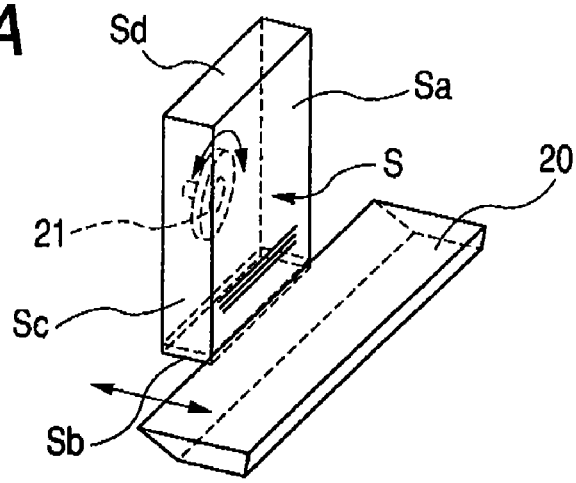
FIGS. 6A, 6B, and 6C are diagrams illustrating a cutting process of the cutting section.
Figure 6B:
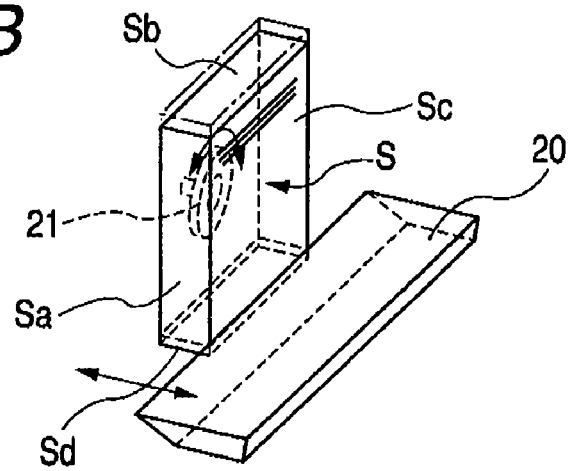
Figure 6C:
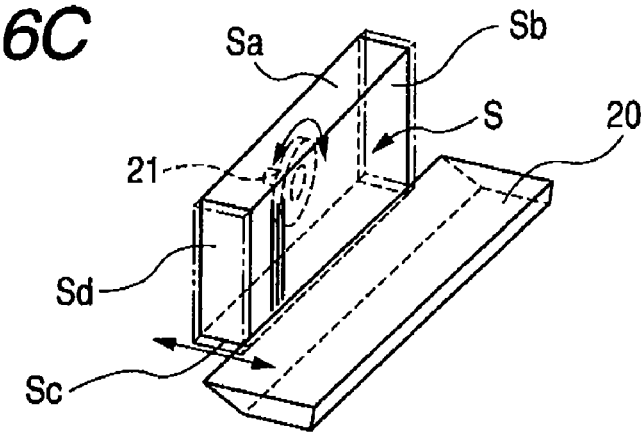

FIG. 1 to FIGS. 6A to 6C illustrate a sheet cutting apparatus of a first embodiment according to the present invention, in which: FIG. 1 illustrates a schematic overall construction thereof; FIG. 2 is a perspective view illustrating a schematic construction of a sheet bundle positioning unit and a cutting section; FIG. 3 is a diagram viewed along a direction shown by an arrow III of FIG. 1; FIG. 4 is a diagram illustrating the construction of a cutting knife driving portion; FIG. 5A is a diagram illustrating a press releasing state of a sheet bundle pressing unit of the sheet cutting apparatus of FIG. 1; FIG. 5B is a diagram illustrating a pressing state of the sheet bundle pressing unit; and FIGS. 6A, 6B, and 6C are diagrams illustrating a cutting process of the cutting section.

A sheet cutting apparatus 1, as described in this embodiment, can be used alone by itself, but can be used as a sheet post-treatment device provided downstream of a sheet conveying route in an image forming system such as a copying machine. In addition, the sheet cutting apparatus may constitute a part of a bookbinding system, for example, a sheet bundle cutting apparatus, and can be applicable to arbitrary uses.

As shown in FIG. 1, the sheet cutting apparatus 1 includes a housing 2 as an outer casing for accommodating various constitutional elements necessary for sheet processing. The housing 2 includes a sheet bundle inlet opening (sheet bundle receiving portion) 3 into which a sheet bundle S including a predetermined number of sheets accumulated in a bundle state is introduced, and a rotatable opening and closing cover 12 for opening and closing the sheet bundle inlet opening 3. Note that, the opening and closing cover 12 is rotatable about a rotation fulcrum 5 which is positioned adjacent to the sheet bundle inlet opening 3 by manually or automatically.

Further, in the housing 2, there are provided a sheet bundle positioning unit 4 for conveying and positioning at a predetermined position the sheet bundle S which is introduced through the sheet bundle inlet opening 3, a sheet bundle cutting section 6 for cutting the sheet bundle S which is positioned by the sheet bundle positioning unit, and a sheet bundle receiving section 8 for receiving the sheet bundle S which has been cut in an accumulation state.

Note that, in this embodiment, description is progressed by assuming that the sheet bundle S onto which a cover is bonded is manually introduced into the sheet bundle inlet opening 3 while being kept in standing vertically by opening the opening and closing cover 12. However, the sheet bundle S may be automatically introduced into the sheet bundle inlet opening 3 through a conveying mechanism (not shown), for example, conveying gripper such as bookbinding device. Alternatively, the sheet bundle S may be introduced from a direction other than vertical, and the sheet bundle S having no cover bonded thereon may be introduced into the sheet bundle inlet opening 3, the introduction modes thereof being arbitrary.

As shown in FIG. 1 and FIG. 2, the sheet bundle conveying and positioning unit 4 includes a pair of first guide plates 9 and a pair of second guide plates 19. Those guide plates 9, 19 are formed of a plate material that elongates in a substantially vertical direction, and define a conveying path in association with each other, which guides the sheet bundle S to be introduced into the sheet bundle inlet opening 3 in a vertical direction while supporting the sheet bundles from both sides thereof. Each of the first guide plates 9 positioned upstream of the conveying direction (upper sides of FIG. 1 and FIG. 2) has on a leading end thereof (in this embodiment, top end) a tapered receiving portion 9*a* that expands in a taper towards the sheet bundle inlet opening 3 and outside so that the sheet bundle S may be received smoothly.

Further, as shown in FIG. 2, each of the first guide plates 9 has a pair of openings 9*b* formed on both right and left sides thereof. To those openings 9*b*, inlet conveying rollers 13, which sandwiches and carries the sheet bundle S to be introduced into the sheet bundle inlet opening 3, are provided so as to be projectable/retractable with respect to the conveying route. In this case, the inlet conveying rollers 13, each being provided correspondingly so as to face with each other on each of the first guide plates 9, change a clearance therebetween, (namely, projection amount with respect to the conveying route is changed (hereinafter, appropriately referred to as "open and close each of the rollers 13")) so that the sheet bundle S to be conveyed through the first guide plate 9 may be sandwiched or released in its sandwiching state. Note that, in this embodiment, the opening and closing between each of the inlet conveying rollers 13 is conducted by a roller opening and closing drive unit 14.

Further, the sheet bundle conveying and positioning section 4 includes a sheet thickness detection sensor 15 for detecting a thickness of the sheet bundle S sandwiched by the inlet conveying rollers 13. The sheet thickness detection sensor 15 operates (detect) in association with the opening and closing of the inlet conveying rollers 13, and transmits a detection signal (information on thickness of the sheet bundle) to a control unit (not shown).

Figure 7:
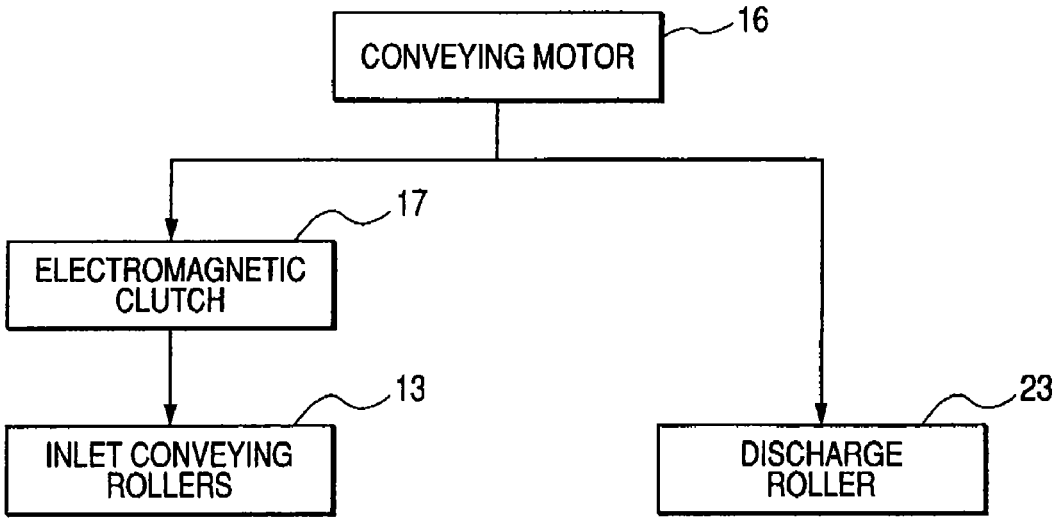
FIG. 7 is a block diagram illustrating a drive system of an inlet conveying roller of the sheet cutting apparatus of FIG. 1.

The inlet conveying rollers 13 is rotatingly driven by a conveying motor 16. In this case, as shown in a block diagram of FIG. 7, a driving force from the conveying motor 16 is adapted to be sent to the inlet conveying rollers 13 through a conveying electromagnetic clutch 17. In other words, when the conveying electromagnetic clutch 17 is actuated (turned ON) while the conveying motor 16 is in a driving state, the rotational force of the conveying motor 16 is transmitted to the inlet conveying rollers 13, and further, when the conveying electromagnetic clutch 17 is released (turned OFF), a rotational force transmitting route from the conveying motor 16 to the inlet conveying rollers 13 is blocked, to thereby stop the rotational movement of the inlet conveying rollers 13.

Through the rotational drive of the inlet conveying rollers 13, the sheet bundle S is conveyed towards a cutting knife 20 described later. In this case, the sheet bundle S conveyed by the inlet conveying rollers 13 falls down by its dead weight while being supported by a second guide plate 19 which is provided upright and substantially perpendicular, and is made to abut on the cutting knife 20 to be positioned. Note that, after the sheet bundle S is discharged from the inlet conveying rollers 13, the electromagnetic clutch 17 is released, the inlet conveying rollers 13 is stopped, and the sheet bundle is positioned at the sheet bundle cutting section 6.

The sheet bundle cutting section 6 includes a rotation movement mechanism 6A which holds the sheet bundle S positioned by the cutting knife 20 and rotates and moves the sheet bundle S in accordance with a predetermined cutting process, a cutting unit 6B which cuts edges of the sheet bundle S supported by the rotation movement mechanism 6A, and a pair of sheet bundle pressing units 6C which press the edges of both ends of the sheet bundle S at the time of cutting the sheet bundle S.

The rotation movement mechanism 6A includes a rotation table 21 which abuts the positioned sheet bundle S, to thereby rotate the sheet bundle S, and a rotatable gripper 22 which presses the sheet bundle S against the rotation table 21, to thereby sandwich and fix the sheet bundle S between the rotation table 21 and the rotatable gripper 22. Note that, the gripper 22 is held by a gripper flame 30, and is adapted to move towards the rotation table 21 by driving a gripper moving device (gripper pressing unit) 34.

Further, the rotation movement mechanism 6A includes a table rotation movement mechanism 36 which rotates and drives the rotation table 21, and freely moves the rotation table 21 towards the cutting unit 6B to position the sheet bundle S held by the rotation table 21 at a predetermined cutting position. In addition, the rotation movement mechanism 6A includes a gripper moving unit 32 which, for example, freely moves the gripper 22 together with the rotation table 21 in association with a table rotation movement mechanism 36 towards the cutting unit 6B, to thereby position the sheet bundle S sandwiched by the rotation table 21 and the gripper 22 at a predetermined cutting position.

Further, at the time of rotating the sheet bundle S sandwiched by the rotation table 21 and the gripper 22 through the table rotation movement mechanism 36, in order to prevent a surface of the sheet bundle S from being damaged when the sheet bundle S comes into contact with the guide plates 19, the rotation movement mechanism 6A is provided with a contact prevention device which prevents the contact of the guide plates 19 and the sheet bundle S by moving the rotation table 21 and the gripper 22 towards a direction orthogonal to the conveying direction of the sheet bundle S to make the sheet bundle S spaced apart from the guide plate 19. In this embodiment, the contact prevention device includes, for example, a table advance/retreat unit 40 which moves the rotation table 21 in an advance/retreat manner towards a direction orthogonal to an extending direction of the guide plates 19 (in this embodiment, horizontal direction vertically extending with respect to the guide plates 19) and a gripper pressing unit 34 which moves the gripper 22 towards the rotation table 21.

On the other hand, the cutting unit 6B which cuts the edges of the sheet bundle S held by the rotation movement mechanism 6A is provided downstream of, rather than the rotation movement mechanism 6A, the sheet bundle conveying route, and includes the cutting knife 20 and a cutting knife drive unit 38 for driving the cutting knife 20. In this case, the cutting knife drive unit 38 is adapted to move the cutting knife 20 so as to draw an arc within a horizontal plane.

Further, the cutting unit 6B includes, in addition to the cutting knife 20 described above, a stationary press plate 20*c* and a movable press plate 20*b* for pressing the edges of the sheet bundle S at the cutting, a press driving motor 52 which drives those plates, a DC motor 20*d* which drives the cutting knife 20 (see FIG. 4), and a cutting knife motor rpm detection device, and those are controlled by the control unit (not shown).

As shown in FIG. 4, a screw 20*e* is rotation-driven by the DC motor 20*d*, and through the rotation, a cutting knife moving device 20*f* is provided with a thrust force via a shaft 20*h*. The cutting knife 20 is constructed so as to carry out the cutting operation along cam grooves 20*g*, and when the thrust force is applied by the cutting knife moving device 20*f*, the cutting knife 20 is constructed to move to a first standby position 20*i*, a cutting termination position 20*j*, and a second standby position 20*k* by one stroke. The first standby position 20*i*, the cutting termination position 20*j*, and the second standby position 20*k* are provided with a first standby position detection device which detects the position of the cutting knife 20, a cutting termination position detection device, and a second standby position detection device (each being not shown), respectively. Switching of the moving direction of the cutting knife 20 is performed by switching between a forward rotation and a reverse rotation of the DC motor 20*d*. In the case where the cutting knife 20 is moved from the first standby position 20*i* to the cutting termination position 20*j*, and further, in the case where the cutting knife 20 is moved from the second standby position 20*k* to the cutting termination position 20*j*, the cam grooves 20*g* are constructed so as to be symmetric with respect to the cutting termination position 20*j* as a center thereof so that the cutting knife 20 is allowed to cut deep into the sheet bundle S by the same shear angle in either case, and is controlled by the control unit to always cut, from the back of the sheet bundle S towards the fore edge thereof, the top edge and the tail edge thereof.

Further, at a position opposed to the cutting knife 20, there is arranged an opposing plate 20A including a knife receiving member (cutting knife pad) 20*m* for receiving the cutting knife 20 (see FIG. 2), and the knife receiving member 20*m* serves as a cutting board at the time of cutting the sheet bundle S with the cutting knife 20. The knife receiving member 20*m* is preferably made of a resin material, and at the time of operation of the cutting knife 20, the cutting knife 20 abut and attached thereto.

The pair of the sheet bundle pressing units 6C, which press the edge portions of the sheet bundle S at the time of cutting the sheet bundle S, each include a drive unit (drive source) 70 which supplies a power which causes a pressing force, a press portion 68 which abut and attached to the edges of the sheet bundle S from a side and presses the edges with respect to the opposing plate 20A or the other opposing member (support surface) by moving towards a direction orthogonal to the conveying direction of the sheet bundle S, and a force conversion and transmission section 72 which converts a driving force from a drive unit 70 into a pressing force in a direction orthogonal to the conveying direction of the sheet bundle S, and transmits the pressing force to the press portion 68.

Figure 8:
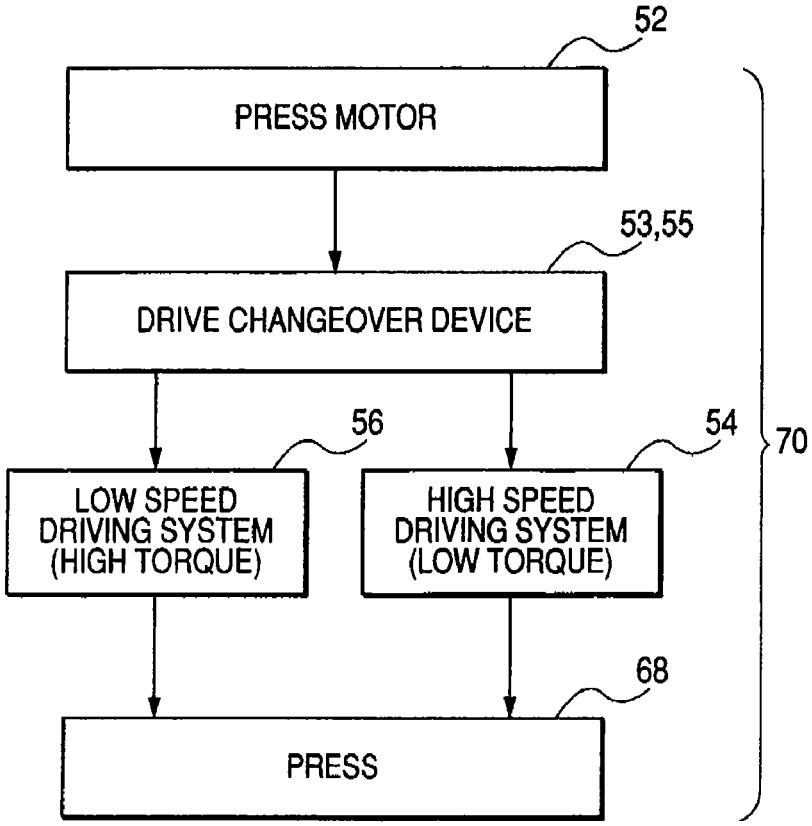
FIG. 8 is a block diagram illustrating a drive system of the sheet bundle pressing unit of the sheet cutting apparatus of FIG. 1.

As shown in block diagrams of FIG. 3, and FIG. 8, the drive units 70 each includes a driving motor (press motor) 52, a high speed driving system (first drive system which causes a small first torque (low torque)) 54 which is constructed of, for example, a predetermined gear strain in which a plurality of gears are engaged with each other, a low speed driving system (second drive system which causes a large second torque (high torque)) 56, a pressing force switching device (drive changeover device) which switches the pressing force to be transmitted to the press portion 68 by selectively transmitting a driving force of the driving motor 52 with respect to the high speed driving system 54 or the low speed driving system 56, a ball screw 57 which is coupled to the high speed driving system 54 and the low speed driving system 56 to form a power output unit which is common to those drive systems 54 and 56, and obtain a rotation force from those drive systems 54 and 56, and a nut 58 which is clamped so as not to be rotated relative to the ball screw 57 and advance/retreats in association with the rotation of the ball screw 57.

In this embodiment, the pressing force switching device includes, for example, a first electromagnetic clutch 53 which is coupled to the high speed driving system 54 and is disengageably engaged with a rotation shaft of the driving motor 52 so that a power force (a rotation force) of the driving motor 52 is transmitted to the high speed driving system 54, and a second electromagnetic clutch 55 which is coupled to the low speed driving system 56 and is disengageably engaged with the rotation shaft of the driving motor 52 so that a power force (rotation force) of the driving motor 52 is transmitted to the low speed driving system 56, but may be constructed of a gear which is coupled to the rotation shaft of the driving motor 52 and selectively engages with a gear of the high speed driving system 54 or the low speed driving system 56 by obtaining a power force of the motor or the like, the switching manner of the gear being arbitrary.

Further, in this embodiment, the switching between the both drive systems 54 and 56 (in this embodiment, ON/OFF switching of electromagnetic clutches 53 and 55) by the pressing force switching device is adapted to be carried out by the control unit (not shown) based on detection information from a sensor which detects that a stationary press plate 20*c* described later of the press portion 68 comes into contact with the edge of the sheet bundle S.

As shown in FIGS. 5A and 5B, the force conversion and transmission portion 72 includes a belt 50 as an advance/retreat member which is coupled to one end of the nut 58 of the drive unit 70, and a moving pulley 45 around which the belt 50 is looped. The moving pulley 45 is supported so as to advance/retreat in a direction (direction indicated by an arrow Y of FIGS. 5A and 5B) orthogonal to the conveying direction (direction indicated by an arrow X of FIGS. 5A and 5B) of the sheet bundle S, and is always urged in a direction which is spaced apart from the conveying route of the sheet bundle S. Further, the other end of the belt 50 is fixed to a fixed member such as the guide plates 19 through a pressure spring 59. In this case, an elastic modulus of the spring 59*a* is set for the pressure spring 59 so as to extend only in the case of receiving a tensile force of predetermined amount or more from the belt 50 (in this embodiment, force caused by low speed driving system 56).

Further, as shown in FIG. 2 and FIGS. 5A and 5B, the press portion 68 includes a stationary press plate 20*c* which directly comes into contact with the edges of the sheet bundle S and presses the edges, and a movable press plate 20*b* which is positioned so as to oppose to the stationary press plate 20*c*, and abut and attached to the stationary press plate 20*c* to act the pressing force thereto.

The movable press plate 20*b* is swingably coupled to a pressure plate 46 which is coupled to, for example, a central portion of the moving pulley 45 through a pivot pin 47 (see arrow A of FIG. 2), and is adapted to receive the pressure force from the pressure plate 46 which interlocks with the moving pulley 45. Note that, in this embodiment, the movable press plate 20*b* is coupled to the pressure plate 46 by its substantially central portion in a longitudinal direction thereof through the pivot pin 47. Further, the stationary press plate 20*c* is supported so as to advance/retreat along the direction orthogonal to the conveying direction of the sheet bundle S, and is adapted to move to the sheet bundle conveying route integrally with the movable press plate 20*b* by the abutting and attaching operation of the movable press plate 20. Then, the stationary press plate 20*c* and the movable press plate 20*b* each has a length which is set so as to abut against the sheet bundle S in its entire width.

Further, in this embodiment, the sheet bundle pressing unit 6C is provided with a press end sensor 60 which detects an extended amount of the pressure spring 59 of the force conversion and transmission section 72. The press end sensor 60 detects, together with the pressure spring 59, that the pressure force applied to the sheet bundle S by the press portion 68 reaches a predetermined value. Note that, if the pressure force only reaches to the predetermined value, arrangement positions of the pressure spring 59 and the press end sensor 60 may be not only on the other end side of the belt 50, for example, but also in a midway portion of the belt 50. In addition, in place of the pressure spring 59, a moving body (weight etc. having a predetermined weight or more) which moves when the tensile force of the predetermined amount or more is received from the belt 50, or the like may be used.

The sheet bundle (sheet bundle) in a glued state is sequentially subjected to a cutting process in three surface sections (top edge, tail edge, and fore edge) by the rotation movement mechanism 6A and the cutting unit 6B (see FIGS. 6A, 6B, and 6C).

To be specific, as shown in FIG. 1, the opening and closing cover 12 is first opened, and the sheet bundle S to which a cover is bonded is set to the sheet bundle inlet opening 3 while keeping the sheet bundle S in a vertical state. The setting like this may be made automatically in the case of post-processing device through the conveying mechanism (not shown) (for example, conveying gripper such as bookbinding device, etc.). However, in this case, the setting is performed by opening the opening and closing cover 12, and by manually introducing the sheet bundle S into the sheet bundle inlet opening 3.

If the sheet bundle S is set as described above, a roller opening and closing drive unit 14 is driven through the detection of the sheet bundle S by a sensor (not shown), and the sheet bundle S is sandwiched by the inlet conveying rollers 13. Further, at this time, the sheet thickness detection sensor 15 is activated in association with the opening and closing operation of the inlet conveying rollers 13 and 13, the thickness of the sheet bundle S sandwiched by the inlet conveying rollers 13 and 13 is detected.

If the thickness of the sheet bundle S is detected by the sheet thickness detection sensor 15, the conveying electromagnetic clutch 17 is turned ON, and the conveying motor 16 is driven. The rotation force of the conveying motor 16 is transmitted to the inlet conveying rollers 13. With this, the inlet conveying rollers 13 rotate, and the sheet bundle S is conveyed in a vertical direction towards the cutting knife 20 side along the guide plates 9 and 19. Further, subsequent to the conveying operation, the conveying electromagnetic clutch 17 is released (OFF), and the sheet bundle S is pushed (bump) against the cutting knife 20 (cutting reference position) to be positioned.

If the sheet bundle S is bumped against the cutting knife 20 being a positioning reference and is positioned, the conveying motor 16 is stopped and the gripper 22 is driven by a gripper pressing unit 34. Then, the sheet bundle S is sandwiched between the rotation table 21 and the gripper 22.

Next, the cutting knife 20 moves to a predetermined position for waiting so as to form a gap which is necessary for the rotation and movement of the sheet bundle S based on the thickness information on the sheet bundle S detected by the sheet thickness detection sensor 15. After that, a table rotation movement mechanism 36 and a gripper moving unit 32 are operated so that the sheet bundle S sandwiched by the rotation table 21 and the gripper 22 is positioned at a predetermined cutting position. To be specific, the sheet bundle S sandwiched by the rotation table 21 and the gripper 22 is turned (rotation by 90°) and moved from a state where a back surface Sa as an edge of covered sheet bundle S is turned downwards to a position where, as shown in FIG. 6A, the top edge Sb as a short edge being the other edge can be cut by the cutting knife 20. At this time, to prevent the surfaces of the sheet bundle S from being damaged due to the rotation thereof, at least one of the table advance/retreat unit 40 and the gripper pressing unit 34 is driven so that the sheet bundle S is rotated in a floating state from the guide plates 19, and at the time point where the rotation is terminated, the sheet bundle S is again brought into contact with the guide plates 19 (opposing plate 20A) by the table advance/retreat unit 40 and the gripper pressing unit 34.

As described above, when the sheet bundle S sandwiched by the rotation table 21 and the gripper 22 is positioned and fixed to a cutting position of the top edge Sb, before cutting the top edge Sb, both the edge portions of the sheet bundle S corresponding to the top edge Sb is pressed by a pair of the sheet bundle pressing units 6C, and the top edge Sb is fixed so as not to move by the cutting force.

To be specific, while in a state where a first electromagnetic clutch 53 is turned ON, and a second electromagnetic clutch 55 is turned OFF, the driving motor 52 is activated, and a rotation force of the driving motor 52 is transmitted to the ball screw 57 through the high speed driving system 54. With this, the ball screw 57 is rotated at high speed, the nut 58 is advanced/retreated at high speed as well as the belt 50 coupled to the nut 58 is pulled at high speed to a direction indicated by an arrow T of FIG. 5B, and the moving pulley 45 moves to the sheet bundle S direction (pressing direction) against the urging force of the urging spring. At this time, a moving amount of the moving pulley 45 is a half of that of the nut 58, but the force (i.e., pressing force) loaded to the moving pulley 45 is two times of the rotation drive force of the ball screw 57. In other word, only a half of the load which is necessary for the press acts on the ball screw 57, namely, the drive unit 70.

If the moving pulley 45 is moved towards the sheet bundle S direction as described above, the movable press plate 20*b* is moved from the standby position towards the sheet bundle S through the pressure plate 46 coupled to the moving pulley 45. With this, the movable press plate 20*b* abuts and attached to the stationary press plate 20*c*, and moves the stationary press plate 20*c* towards the sheet bundle S (see FIG. 5B). After that, the fact that the stationary press plate 20*c* is brought into contact with the edge of the sheet bundle S is detected by a sensor (not shown), the first electromagnetic clutch 53 is turned OFF, the second electromagnetic clutch 55 in turned ON, and the rotation force of the driving motor 52 is transmitted to the ball screw 57 through the low speed driving system 56. In this case, since the edge of the sheet bundle S and the stationary press plate 20*c* has already come in contact with each other, the moving pulley 45 does not move. However, a large torque is transmitted from the low speed driving system 56 to the movable press plate 20*b* through the moving pulley 45, and a large pressing force acts on the edge of the sheet bundle S from the movable press plate through the stationary press plate 20*c*. That is, the edge of the sheet bundle S is sandwiched between the opposing plate 20A and the stationary press plate 20*c* with a predetermined pressing force. Further, at this time, since the moving pulley 45 does not move though the belt 50 is pulled, the pressure spring 59 starts to extend.

Note that, in the pressing operation described above, the pressing force uniformly acts on an entire width of the sheet bundle S. This is because, as described above, the movable press plate 20*b* is swingably coupled to the pressure plate 46 through the pivot pin 47. In other words, with employment of this type of a swing mechanism, at the time of transmitting the pressing force, an inclination of the movable press plate 20*b* with respect to the sheet bundle S and the stationary press plate 20*c* is corrected by the swing operation, between the movable press plate 20*b* and the stationary press plate 20*c* is kept in parallel (bias abutment of the stationary press plate 20*c* to the sheet bundle S is eliminated), and the pressing force uniformly acts on the entire width of the sheet bundle S. Thus, when the cutting knife 20 trims the edges of the sheet bundle S, a sufficient pressing force can be obtained, thereby being capable of enhancing cutting precision.

With the above-mentioned pressing operation, when the uniform pressing force applied to the sheet bundle S reaches to a predetermined value, the pressure spring 59 extends to a position of the press end sensor 60, and this state is detected by the press end sensor 60. With this, the operation of the driving motor 52 is stopped and the predetermined pressing force is maintained.

As described above, while in the state where the predetermined pressing force is maintained, the cutting knife drive unit 38 is driven, and the cutting of top edge Sb by the cutting knife 20 is carried out. To be specific, the cutting knife 20 is moved so as to draw an arc within a horizontal plane, the edge of the top edge Sb is trimmed. At this time, as described above, the knife receiving member 20*m* made of a material such as plastic, rubber, or the like for receiving the knife edge of the cutting knife 20 is provided to the opposing plate 20A, so the knife edge of the cutting knife 20 may be protected. Further, the cutting wastage having cut with the cutting operation described above falls down by its self-weight, and is received into a waste box 100 described later.

If the edge of the top edge Sb is cut as described above, such a sate is detected by a cutting end sensor (not shown), and the cutting knife 20 moves again to a predetermined position for waiting based on the information on the thickness of the sheet bundle S in order to form a gap which is necessary for the sheet bundle S to rotate and move. Further, at the same time, the pressing force caused by the press portion 68 is also released. In other words, ON/OFF states of the electromagnetic clutches 53 and 55 are switched as well as the driving motor 52 is driven reversibly, and the movable press plate 20*b* is caused to return to a standby position by the high speed driving system 54, thus terminating a series of cutting operation for the top edge Sb.

Subsequently, the tail edge Sd as a short edge being the other edge of the sheet bundle S is cut. For that reason, the table rotation movement mechanism 36 and the gripper moving unit 32 are driven again, and the sheet bundle S sandwiched by the rotation table 21 and the gripper 22 is turned (rotation by 180°) and moved from a state where the top edge Sb is turned downwards to a position where, as shown in FIG. 6B, the tail edge Sd can be cut by the cutting knife 20. Then, when the sheet bundle S is fixed to the cutting position of the tail edge Sd, by the same process as in the top edge Sb described above, the pressing and the cutting of the tail edge Sd are carried out. In addition, thereafter, the sheet bundle S is turned by 90° by the same manner, the cutting of the fore edge Sc as a long edge being the rest edge is carried out by the same process (see FIG. 6C). Note that, the tail edge Sd is cut after cutting the top edge Sb in this case. However, the top edge Sb may be cut after cutting the tail edge Sd. In short, the long edge may be cut finally after cutting the two short edges of the sheet bundle.

Then, the sheet bundle whose 3 surface sections have been cut is conveyed to the moving route T which extends in a perpendicular direction, while being sandwiched by the above-mentioned gripper 22 and rotation table 21. Provided to the moving route T are a pair of guide plates 90 which guide the sheet bundle S1 which has bee cut to the vertical direction, while supporting from both sides thereof, and discharge rollers 23 which blow out the sheet bundle S1 which has been cut along the guide plates 90 from the sheet bundle cutting section. Further, an accommodation portion 24 is provided to receive the sheet bundle S1 sequentially as it is. The sheet bundle S1 which has been cut is discharged within the moving route T, while being sandwiched by the above-mentioned gripper 22 and the rotation table 21 in a floating state from the guide plates 19, and in a state where the back surface Sa is turned downwards. When the sheet bundle S1 is detected that the sheet bundle S1 is positioned between the discharge rollers 23 by a sensor (not shown), the sandwiching state by the gripper 22 and the rotation table 21 is released, and thereafter, the sheet bundle S1 is sent into the accommodation portion 24 through the discharge rollers 23 only. In this case, the sheet bundle S1 which is blown out by the discharge rollers 23 is pressed into the accommodation portion 24 by a side-wall portion of a sub-waste box described later, and is received in stack under a state where the edge Sa onto which the cover is bonded is turned downwards and the sheet bundle S1 is substantially vertically upright.

Figure 9:
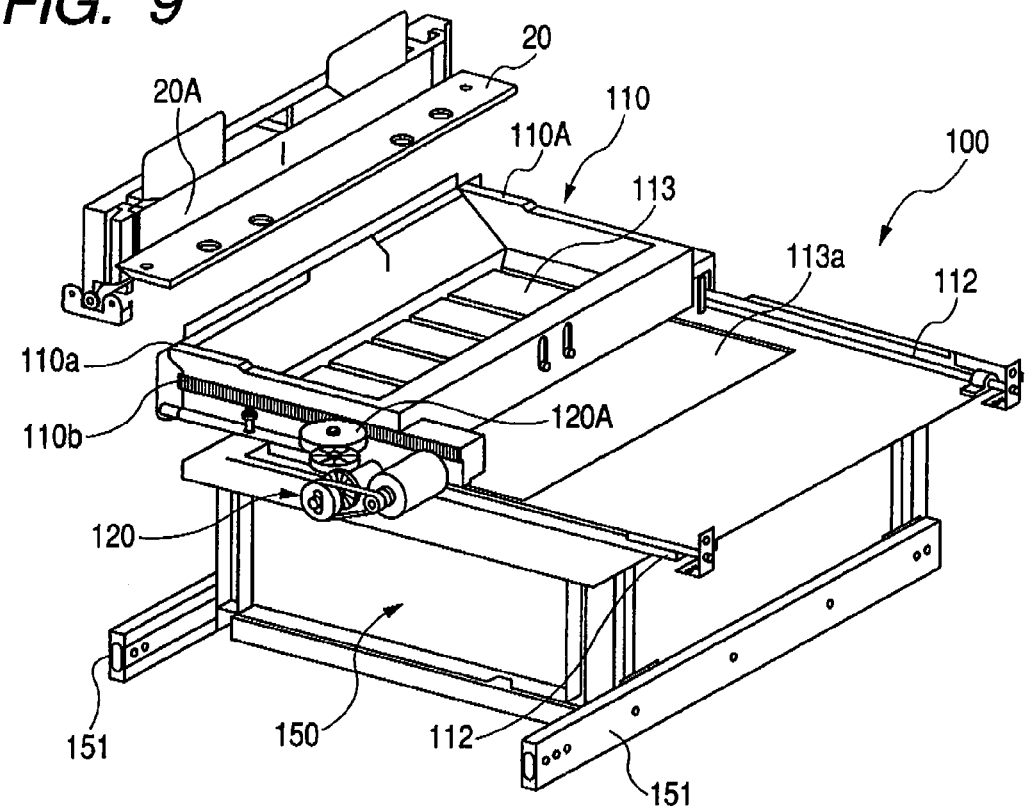
FIG. 9 is a diagram illustrating the construction of a waste box for receiving cutting wastage.
Figure 10:
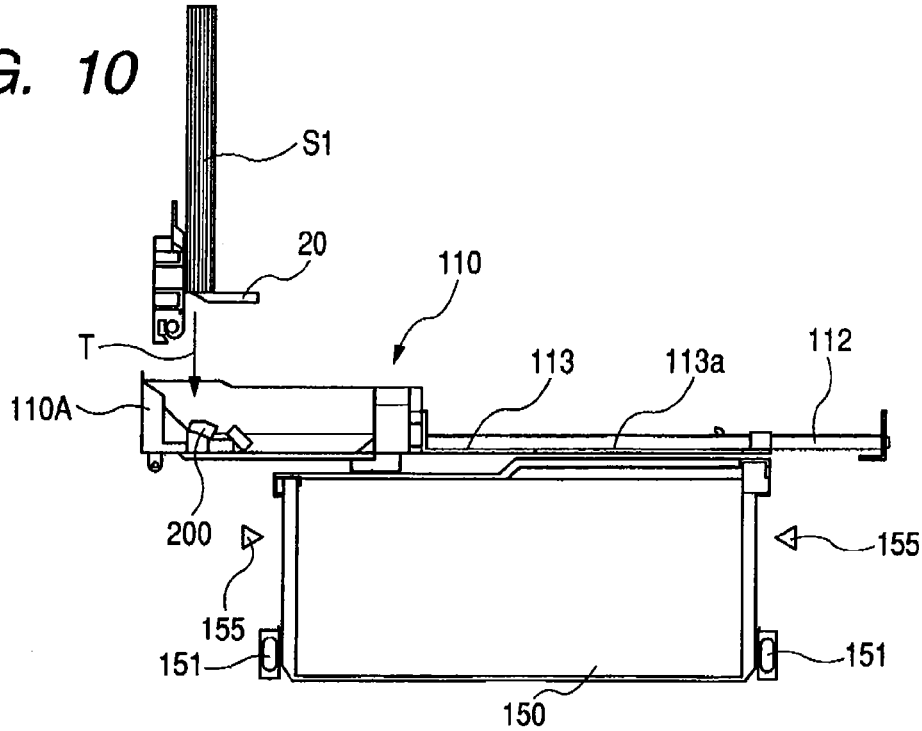
FIG. 10 is a diagram illustrating a wastage receiving state of the waste box of FIG. 9.
Figure 11:
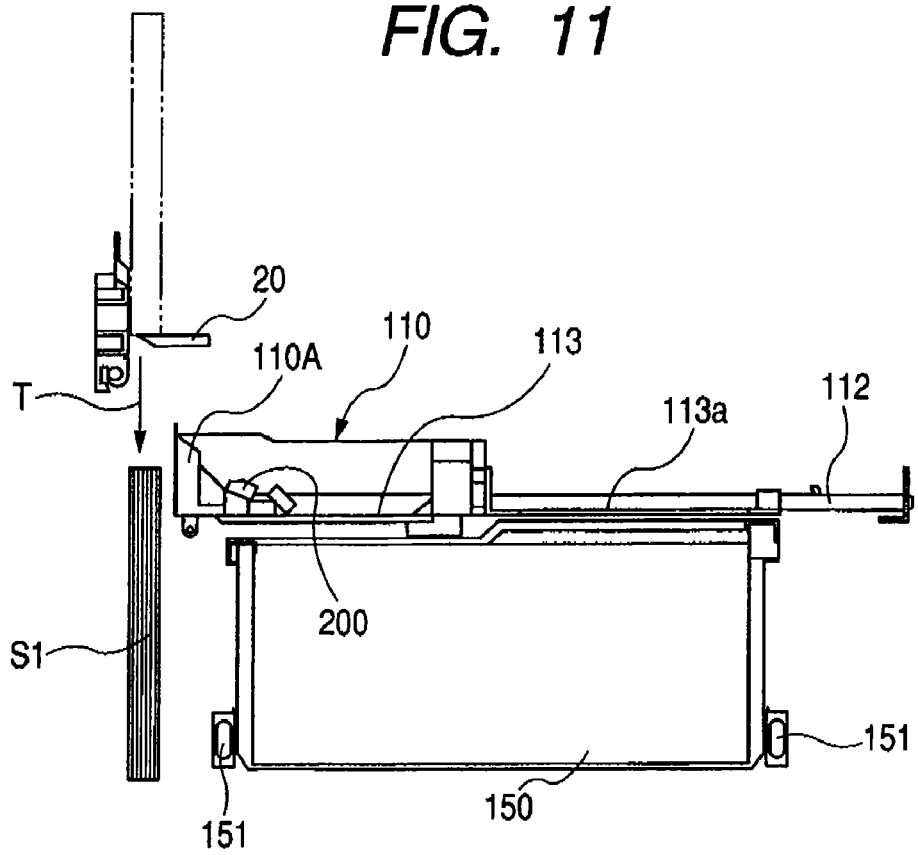
FIG. 11 is a diagram illustrating discharge operation of a sheet bundle.
Figure 12:
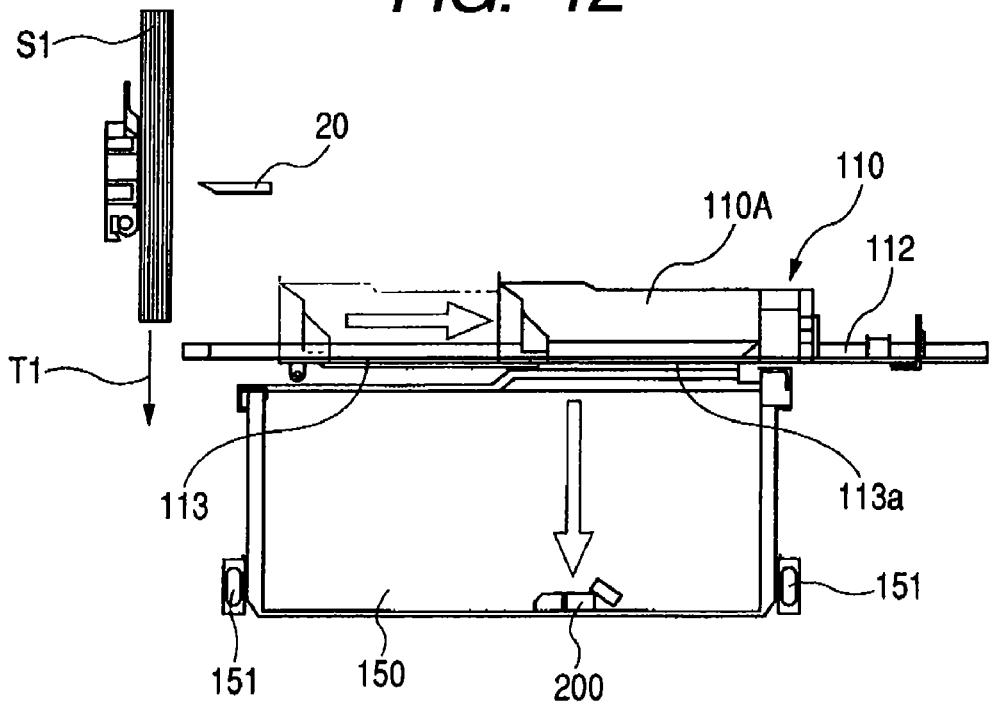
FIG. 12 is a diagram illustrating a state in which the cutting wastage is disposed from the sub-waste box to the main waste box.
Figure 13:
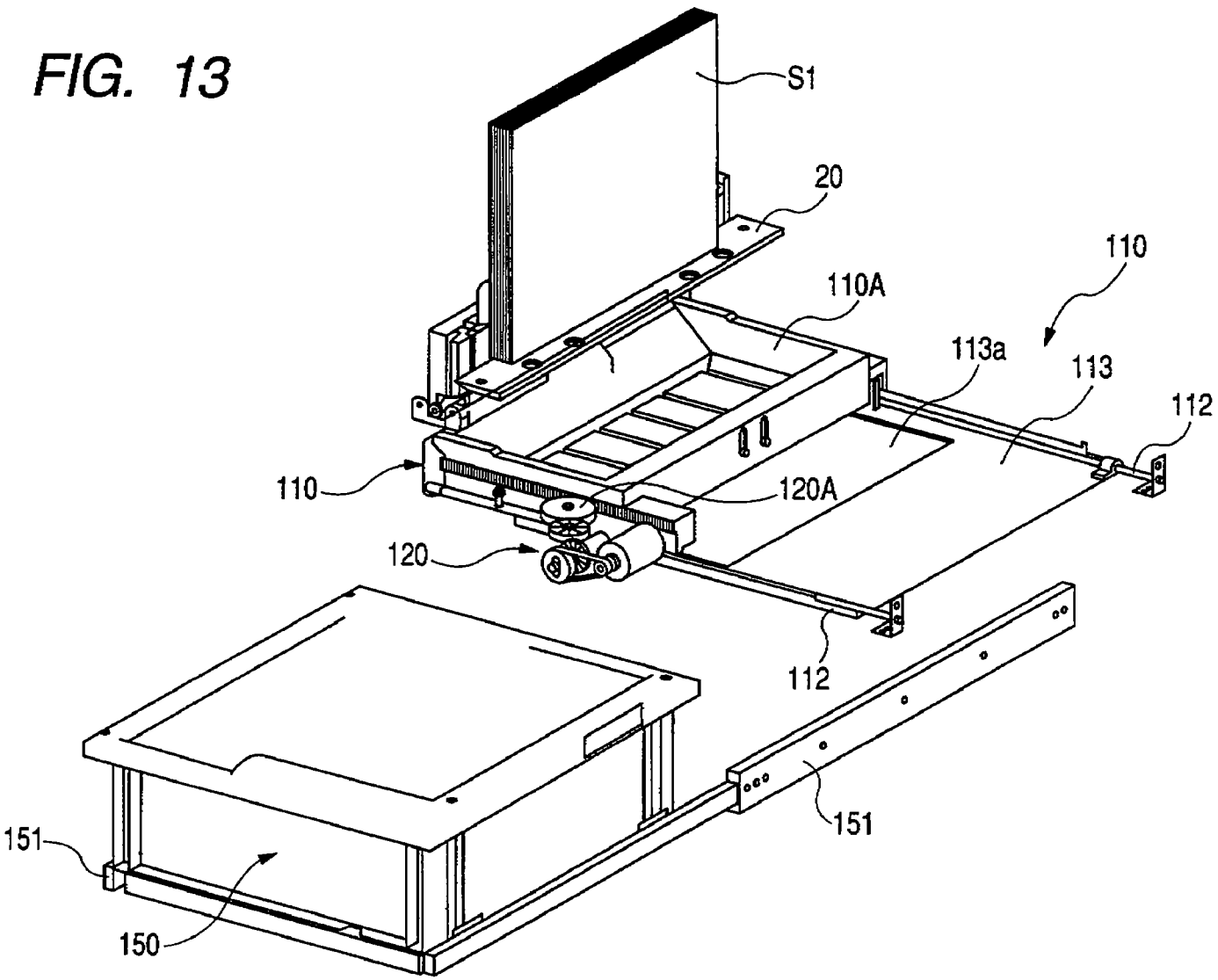
FIG. 13 is a diagram illustrating a state in which the main waste box is pulled out.

Next, description is made of the construction of a waste box 100 which receives cutting wastage caused in the above-mentioned cutting process with reference to FIG. 1, and FIG. 9 to FIG. 13. Note that, in those drawings, FIG. 9 is a diagram illustrating the construction of a waste box for receiving cutting wastage, FIG. 10 is a diagram illustrating a wastage receiving state of the waste box of FIG. 9, FIG. 11 is a diagram illustrating discharge operation of a sheet bundle, FIG. 12 is a diagram illustrating a state in which the cutting wastage is disposed from the sub-waste box to the main waste box, and FIG. 13 is a diagram illustrating a state in which the main waste box is pulled out.

The waste box 100 includes a sub-waste box 110 capable of temporally receiving cutting wastage and a main waste box 150 capable of receiving the cutting wastage received in the sub-waste box 110. The sub-waste box 110 and the main waste box 150 are constructed to constitute such a relation that the wastage disposal operation of the cutting wastage contained in the main waste box 150 can be carried out while the sub-waste box 110 is actually receiving the cutting wastage of the sheet bundle. Specific structure thereof is described hereinafter.

The main waste box 150 is provided to an inside frame of the housing of a sheet cutting apparatus 1, and has a substantially rectangular shape with a top being opened. In this case, within the inside frame, a pair of slide rails 151 are provided for slidably supporting the main waste box 150 in a direction perpendicular to a paper surface, and the main waste box 150 can be pulled out by releasing an opening and closing door (not shown) provided to the housing. In other words, the main waste box 150 is constructed independently movable without a relation with the sub-waste box 110 so that, even if the sub-waste box 110 disposed above the main waste box 150 is under a state of receiving the cutting wastage during the cutting process of the sheet bundle, the main waste box 150 can be pulled out with respect to, for example, a pair of the slide rails 151 constituting the apparatus main body, and the wastage disposal operation of the cutting wastage contained in the main waste box can be carried out.

Note that, about the construction within the main waste box 150, which allows the wastage disposal operation of the cutting wastage, there may employ such a construction that, other than the pull-out operation is performed using a pair of the slide rails as described above, for example, the main waste box 150 is pulled out by turning ahead with respect to the apparatus main body.

To the slide rail 151 (or vicinity thereof), there is provided a mount detection device (constructed of a sensor, etc.) which detects that the main waste box 150 is set at a regular position (position to be set to the inside frame), and attached to the main waste box 150 is a pre-fill-up detection sensor 155 for detecting the fill-up state of the cutting wastage. The pre-fill-up detection sensor 155 is provided at a position where, after the fill-up state is detected for the cutting wastage, the cutting wastage can be received to some extent.

Above the main waste box 150, the sub-waste box 110 is disposed. The sub-waste box 110 has a substantially rectangular shape with a top being opened, which is smaller than the main waste box 150, and is disposed slidably movable independently with the main waste box 150. To be specific, the sub-waste box 110 is slidably supported to a pair of slide rails 112 provided to the inside frame in a direction orthogonal to the slide rail 151, and is movable without a relation with the movement of the main waste box 150 above the main waste box 150. In addition, the sub-waste box 110 is disposed so that the cutting wastage contained therein may fall down to the main waste box 150.

Specifically, a bottom plate 113, which is slidably movable together with its main body 110A, and the main body 110A alone may be relatively movable, is provided to the sub-waste box 110. The bottom plate 113 constitutes the sub-waste box 110 together with the main body 110A, and is constructed so that the cutting wastage which falls within the sub-waste box 110 can be contained therein.

The bottom plate 113 is, as shown in FIG. 9, supported to the slid rails 112, and is slidably movable together with the main body 110A into the moving route of the sheet bundle S1. In this case, the bottom plate 113 is slidably movable into the moving route (moving route T; see FIG. 10) in which the sheet bundle S1 after the cutting operation by the cutting process described above falls down as it is. In other words, the sub-waste box 110 is constructed to move together with the main body 110A to receive the cutting wastage which falls down as it is from the sheet bundle S1 which is subjected to the cutting processing when the bottom plate 113 is moved into the moving route of the sheet bundle S1.

Then, when the sub-waste box 110 is retracted from the moving route T to move to a position where the sheet bundle S1 is fallen down (see FIG. 11), the bottom plate 113 moves together T with the main body 110A to release the moving route.

Further, as described above, the sub-waste box 110 is constructed so that the cutting wastage contained therein can be fallen down with respect to the main waste box 150 disposed below the sub-waste box 110. To be specific, for example, the bottom plate 113 has an opening 113*a* formed on one end side, and when the main body 110A is relatively moved to the bottom plate 113 in a retreating direction, the main body 110A is positioned at the opening 113*a* and the cutting wastage contained therein is fallen down as it is within the main waste box 150. In other words, to transfer the cutting wastage contained in the sub-waste box 110 to the main waste box 150, if the sub-waste box 110 is further moved, as shown in FIG. 12, in the retreating direction from the state as shown in FIG. 11, the main body 110A alone is slidably moved relative to the bottom plate 113, the main body 110A is positioned at the opening 113*a*, and the cutting wastage is fallen down.

The sub-waste box 110 is constructed so as to be slidably movable by a driving source such as a driving motor 120 which is held by the inner frame. To be specific, a pinion gear 120A of a power transmission mechanism which reduces an rpm of a rotation drive force of the driving motor 120 for transmission is engaged with a rack 110*b* provided onto one side wall 110*a* of the sub-waste box 110, so the sub-waste box 110 is reciprocatingly driven in a direction along the slide rail 112. As described above, when the cutting operation is carried out by the cutting knife 20, the sub-waste box 110 is positioned at the receiving position for receiving the falling cutting wastage, i.e., into the moving route T into which the sheet bundle falls down, together with the bottom plate 113 in this embodiment (see FIG. 10). Then, when the sheet bundle S1 falls down, the sub-waste box 110 is positioned at the retracting position together with the bottom plate 113 (see FIG. 11), and when the cutting wastage within the sub-waste box 110 is fallen into the main waste box 150, the main body 110A alone is further slidingly moved to be positioned at the opening 113*a* of the bottom plate 113 (see FIG. 12).

Specifically, description will be made of the wastage processing operation of the above-mentioned waste box 100.

In the above-mentioned cutting section, when the cutting processing is stated for the sheet bundle, the sub-waste box 110 is driven by the driving motor 120 along the slide rail 112 and moved to the wastage receiving position as shown in FIG. 9 and FIG. 10. At this time, when the sheet bundle S1 is subjected to the cutting processing, a cutting wastage 200 thereof falls down by its dead weight to be temporally receive within the sub-waste box 110.

If the cutting processing of the sheet bundle S1 is terminated, the sub-waste box 110 is moved to the retracting position shown in FIG. 11 by the driving motor 120 so the sheet bundle S1 as to be fallen down. At this time, the cutting wastage 200 is positioned above the bottom plate 113. Then, if the falling down of the sheet bundle S1 is detected, the sub-waste box 110 returns again to the wastage receiving position followed by the preparation for the next cutting operation of the sheet bundle. Note that, at this time, it may employ such a construction that a front wall portion of the main body 110A abuts and attached to the fallen sheet bundle S1 to guide the sheet bundle S1 into the accommodation portion 24.

Then, under the above-mentioned processing operation, if the main waste box 150 is judged that the main waste box 150 is correctly mounted to the inside frame by a mount detection device (not shown), the sub-waste box 110 is moved to the position shown in FIG. 12. With this movement, the bottom plate 113 does not move as different from the case described above, and the main body 110A alone moves. The cutting wastage 200 contained inside falls down through the opening 113*a* into the main waste box 150.

To the main waste box 150, as described above, the pre-fill-up detection sensor 155 is provided, so the drive control unit of the driving motor 120 which drives the sub-waste box 110 may control such that, if the wastage disposal operation is carried out for multiple times and the cutting wastage is collected to be detected pre-fill-up state, the sub-waste box 110 is not moved on the opening 113*a* side.

Further, the drive control unit, as shown in FIG. 13, control such that, if the main waste box 150 is pulled-out and it is detected that the main waste box 150 is not correctly mounted to the inside frame by the mount detection device, the sub-waste box 110 is not moved on the opening 113*a* side. In other words, if the main waste box 150 is removed, or the cutting wastage is collected to be full, the cutting wastage is received by the sub-waste box 110.

The sub-waste box 110 is constructed so as to receive the cutting wastage of a plurality of sheet bundles, so when the main waste box 150 is pulled-out, or the like, the sub-waste box 110 is controlled so as not to move on the opening 113*a* side, to thereby allow the plurality of the bundles to be processed without stopping the device while a user is conducting wastage disposal operation.

Further, in this embodiment, the sub-waste box 110 disposed above the main waste box 150 is constructed such that the operator can not access the cutting knife 20. To be specific, when the apparatus main body is released, the sub-waste box 110 blocks a press region of the sheet bundle or the cutting knife 20 by the bottom plate 113, as shown in FIG. 11 and FIG. 12, so the operator may be enhanced with the safety of the processing operation of the cutting wastage.

As described above, description was made of the embodiments of the present invention, however the present invention has a feature in the structure of the waste box which receives the cutting wastage of the sheet bundle, which occurred during the cutting operation, so the structure of the sheet cutting device, a cutting method for a sheet bundle, or the like is not limited to the above-mentioned embodiments, but may be modified variously.

Further, about the waste box disposed below the cutting section, it may constructed such that the sub-waste box which temporally receives the cutting wastage is disposed, and the cutting wastage within the sub-waste box is optionally discard to the main waste box, so the engagement relation between the both box, or a discarding method for cutting wastage is not limited to the above-mentioned embodiments, but may be modified appropriately.

According to the above-mentioned embodiments, there is provided a sheet cutting apparatus having a simple structure and allows easy wastage processing by a user with safety.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefits of Japanese Patent Application No. 2007-155167 filed Jun. 12, 2007, which is hereby incorporated by reference herein in its entirety.

What is claimed is:

1. A sheet cutting apparatus, comprising:

a cutting knife for cutting a sheet bundle including a plurality of sheets;

a sub-waste box, which temporally receives cutting wastage of a sheet bundle which has been cut;

a main waste box, which receives the cutting wastage received in the sub-waste box; and a mount detection device, which detects whether the main waste box is present, wherein the sub-waste box is movable between a first position, in which the sub-waste box receives cutting wastage of a sheet bundle which has been cut, and a second position, in which the sub-waste box allows cutting wastage to fall down to the main waste box, and wherein when the mount detection device detects that the main waste box is not present, the sub-waste box is prevented from moving to the second position.

2. A sheet cutting apparatus according to claim 1, wherein the sub-waste box is provided above the main waste box and is movable so that the cutting wastage falls from the sub-waste box to the main waste box.

3. A sheet cutting apparatus according to claim 1, wherein when the sub-waste box is in the first position, the sub-waste box prevents access to the cutting knife during the wastage disposal operation of the main waste box.

4. A sheet cutting apparatus according to claim 1, wherein when the mount detection device detects that the main waste box is not present, the cutting knife can cut a sheet bundle and the sub-waste box receives cutting wastage in the first position.

* * * * *